US006382187B1

(12) United States Patent
Scollard et al.

(10) Patent No.: US 6,382,187 B1
(45) Date of Patent: May 7, 2002

(54) CLIP FOR ATTACHMENT OF FUEL SUPPLY ASSEMBLY

(75) Inventors: Joseph Edward Scollard, Suffolk; Stephen C. Bugos, Newport News, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/575,728

(22) Filed: Aug. 7, 2000

(51) Int. Cl.[7] ..... F02M 55/02
(52) U.S. Cl. ..... 123/470; 123/468
(58) Field of Search ..... 123/470, 468, 123/469, 471, 446, 445

(56) References Cited

U.S. PATENT DOCUMENTS

| | | | | |
|---|---|---|---|---|
| 4,984,548 A | | 1/1991 | Hudson, Jr. | 123/470 |
| 4,991,557 A | | 2/1991 | DeGrace et al. | 123/470 |
| 5,038,738 A | | 8/1991 | Hafner et al. | 123/470 |
| 5,111,794 A | | 5/1992 | DeGrace, Jr. | 123/470 |
| 5,168,625 A | | 12/1992 | DeGrace, Jr. | 29/888.01 |
| 5,209,204 A | | 5/1993 | Bodenhaussen et al. | 123/470 |
| 5,211,149 A | | 5/1993 | DeGrace, Jr. | 123/470 |
| 5,301,647 A | | 4/1994 | Lorraine | 123/470 |
| 5,520,151 A | | 5/1996 | Gras et al. | 123/470 |
| 5,598,824 A | | 2/1997 | Treusch et al. | 123/470 |
| 5,724,946 A | | 3/1998 | Franchitto | 123/470 |
| 5,743,235 A | | 4/1998 | Lueder | 123/468 |
| 5,803,052 A | * | 9/1998 | Lorraine et al. | 123/470 |
| 5,893,351 A | * | 4/1999 | Akutagawa et al. | 123/470 |
| 5,934,253 A | | 8/1999 | Kojima et al. | 123/470 |
| 5,934,254 A | * | 8/1999 | Vetters et al. | 123/470 |
| 5,960,774 A | | 10/1999 | Norgauer et al. | 123/470 |
| 5,967,121 A | | 10/1999 | Pirch et al. | 123/470 |
| 5,970,953 A | * | 10/1999 | Lorraine et al. | 123/470 |
| 6,053,149 A | * | 4/2000 | Lorraine | 123/470 |

* cited by examiner

*Primary Examiner*—Bibhu Mohanty

(57) ABSTRACT

The present invention provides an assembly having a fuel injector and a fuel supply device. The fuel injector has first and second ends, a fuel metering portion, having a longitudinal axis extending therethrough, an outer shell surrounding the fuel metering portion, and at least one fixing member extending radially from the outer shell proximate the first end. The fixing member has first and second longitudinal legs extending to a first transverse leg, where all of the legs form a void. Each longitudinal leg has a first portion extending from the outer shell and a second portion that is substantially parallel to the longitudinal axis. The first transverse leg has a substantially planar surface. The fuel supply device has a cup with an injector receiving opening and at least one tab, extending generally radially from the cup. The first end of the fuel injector is disposed in the injector receiving opening. The at least one tab is adapted to releasably engage the fixing member and has a configuration that corresponds with the configuration of the void.

17 Claims, 2 Drawing Sheets

CLIP FOR ATTACHMENT OF FUEL SUPPLY ASSEMBLY

BACKGROUND OF INVENTION

Field of Invention

The present invention relates to the field of fuel supply assemblies, and more particularly, to a clip for attachment of a fuel injector to a fuel supply device.

There are many types of attachment devices to retain a fuel injector to a fuel supply device. The attachment device may be a clip that secures a fuel injector inserted into a cup, which is part of the fuel supply device. Each clip is a separate part and thus, it is believed that elimination of the clip will reduce the number of parts required in the assembly of a fuel supply system.

SUMMARY OF INVENTION

The present invention provides an assembly having a fuel injector and a fuel supply device. The fuel injector has first and second ends, a fuel metering portion, having a longitudinal axis extending therethrough, an outer shell surrounding the fuel metering portion, and at least one fixing member extending radially from the outer shell proximate the first end. The fixing member has first and second longitudinal legs extending to a first transverse leg, where all of the legs form a void. Each longitudinal leg has a first portion extending from the outer shell and a second portion that is substantially parallel to the longitudinal axis. The first transverse leg has a substantially planar surface. The fuel supply device has a cup with an injector receiving opening and at least one tab, extending generally radially from the cup. The first end of the fuel injector is disposed in the injector receiving opening. The at least one tab is adapted to releasably engage the fixing member and has a configuration that corresponds with the configuration of the void.

The present invention also provides a method of releasably connecting a fuel cup to a fuel injector. This method includes: providing a fuel injector, having first and second ends and a longitudinal axis extending therethrough, that includes an outer shell and at least one fixing member extending radially from the outer shell, and a fuel supply device including a cup with at least one tab, having a mating surface; and inserting the cup over the first end of the fuel injector. The fixing member has first and second longitudinal legs extending to a transverse leg with a substantially planar surface and a surface extending toward the second end of the fuel injector and toward the longitudinal axis. The method also includes: engaging the at least one tab with the surface extending toward the second end; biasing the surface extending toward the second end, the first and second longitudinal legs, and the transverse leg from a first position away from the longitudinal axis; and engaging the mating surface of the at least one tab with the substantially planar surface of the fixing member so that the first and second longitudinal legs and the transverse leg return to the first position.

The present invention also provides a method of disengaging a fuel cup from a fuel injector. This method includes: providing a fuel injector, having first and second ends and a longitudinal axis extending therethrough, including an outer shell, at least one fixing member extending radially from the outer shell, where the fixing member has first and second longitudinal legs that extend to a transverse leg with a substantially planar surface and where the first and second longitudinal legs and the transverse leg form a void, and a fuel supply device including a cup with at least one tab, which has a mating surface, where the cup engages the first end of the outer shell; pressing the cup toward the second end of the fuel injector along the longitudinal axis; biasing the transverse leg from a first position to a second position away from the longitudinal axis so that the mating surface of the tab releases from the substantially planar surface of the transverse leg and exits the void; and advancing the cup along the longitudinal axis and releasing the transverse leg so that the transverse leg returns to the first position.

BRIEF DESCRIPTION OF DRAWINGS

The accompanying drawings, which are incorporated herein and constitute part of this specification, illustrate the presently preferred embodiment of the invention, and, together with the general description given above and the detailed description given below, serve to explain the features of the invention.

DETAILED DESCRIPTION

Figure 1:
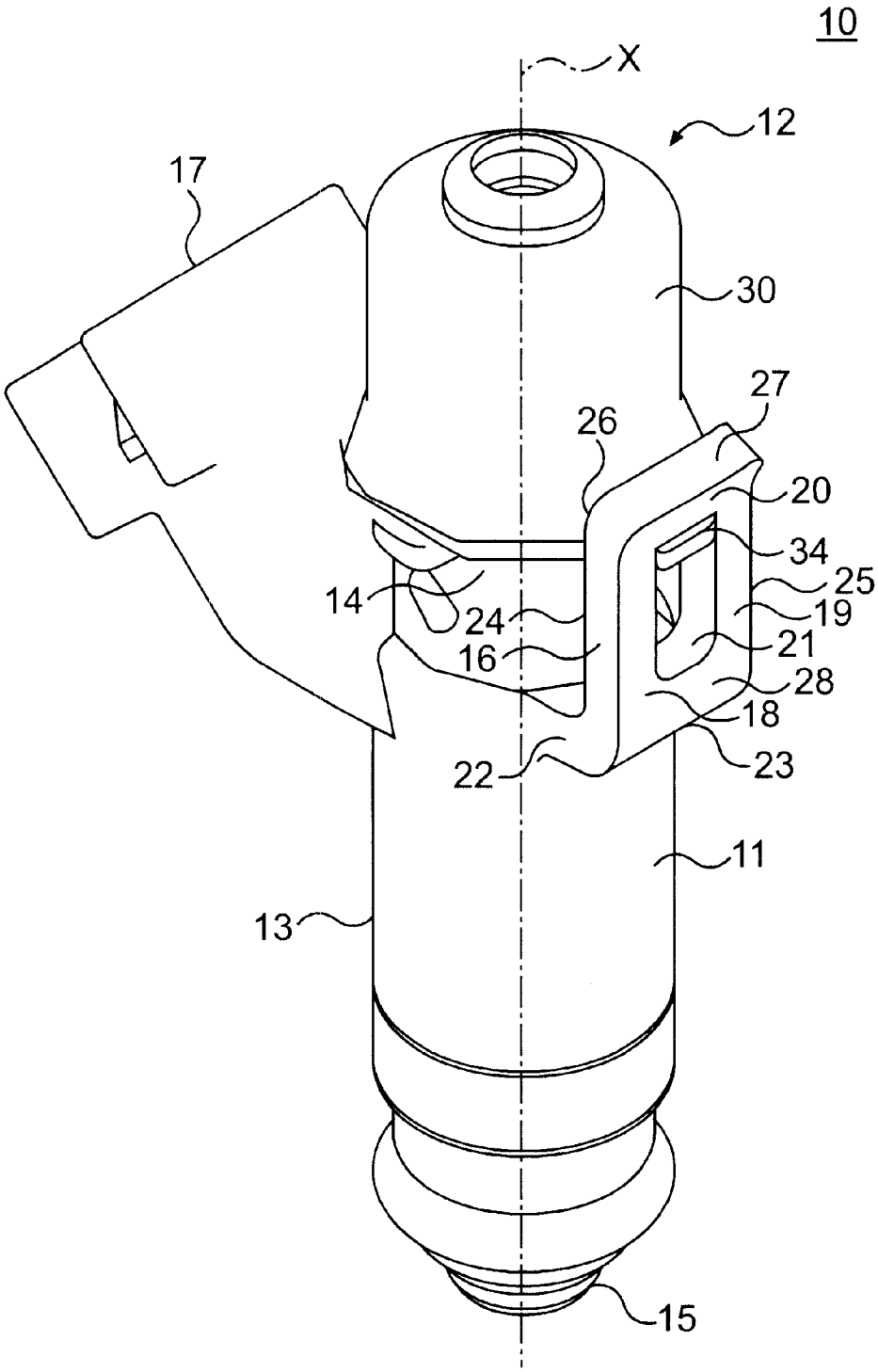
FIG. 1 is a top-frontal view of a preferred embodiment of the assembly of the present invention.

FIG. 1 illustrates a preferred embodiment of the assembly 10 that releasably engages a fuel injector 11 to a fuel supply device. The fuel injector 11 has a fuel metering portion 12 with a longitudinal axis x extending therethrough and first and second ends, 14 and 15, respectively. An outer shell 13 surrounds the fuel metering portion 12. Fuel flows into the fuel metering portion 12 into a fuel inlet at the first end 14 and exits the fuel metering portion 12 out of a fuel outlet at the second end 15. At least one fixing member 16 extends radially from the outer shell 13 proximate the first end 14. Preferably, there is one fixing member 16 diametrically opposed from an electrical connector 17 extending from the outer shell 13. However, there may be two or more fixing members 16 extending radially from the outer shell 13. The fuel supply assembly may also include a fuel channel (not shown) that supplies fuel to the fuel injector 11 and an electrical connector receptacle (not shown) that engages the electrical connector 17.

The fixing member 16 has first and second longitudinal legs, 18 and 19, respectively, extending to a first transverse leg 20, which is transverse to the first and second longitudinal legs 18 and 19. The first and second longitudinal legs 18 and 19 each have a first portion 22 and 23, respectively, extending from the fuel injector 11 and a second portion 24 and 25, respectively, that is substantially parallel to the longitudinal axis x. Preferably, the first and second longitudinal legs 18 and 19 are parallel to each other. Together, the legs 18, 19, and 20 form a void 21. The first transverse leg 20 has a substantially planar surface 26 that, preferably, defines a boundary of the void 21. Preferably, the first transverse leg 20 is biased toward the first end 14 of the fuel injector 11. In the preferred embodiment, the first transverse leg 20 has a surface 27 extending toward the second end 15 of the fuel injector 11 and toward the longitudinal axis x. In the preferred embodiment, a second transverse leg 28, which is substantially parallel to the first transverse leg 20 and preferably, transverse to the longitudinal legs 18 and 19, extends from the first longitudinal leg 18 to the second longitudinal leg 19. Preferably the second transverse leg 26 engages the first longitudinal leg 18 and the second longitudinal leg 19 between the first portion 22 and 23, respectively, and second portion 24 and 25, respectively.

Figure 2:
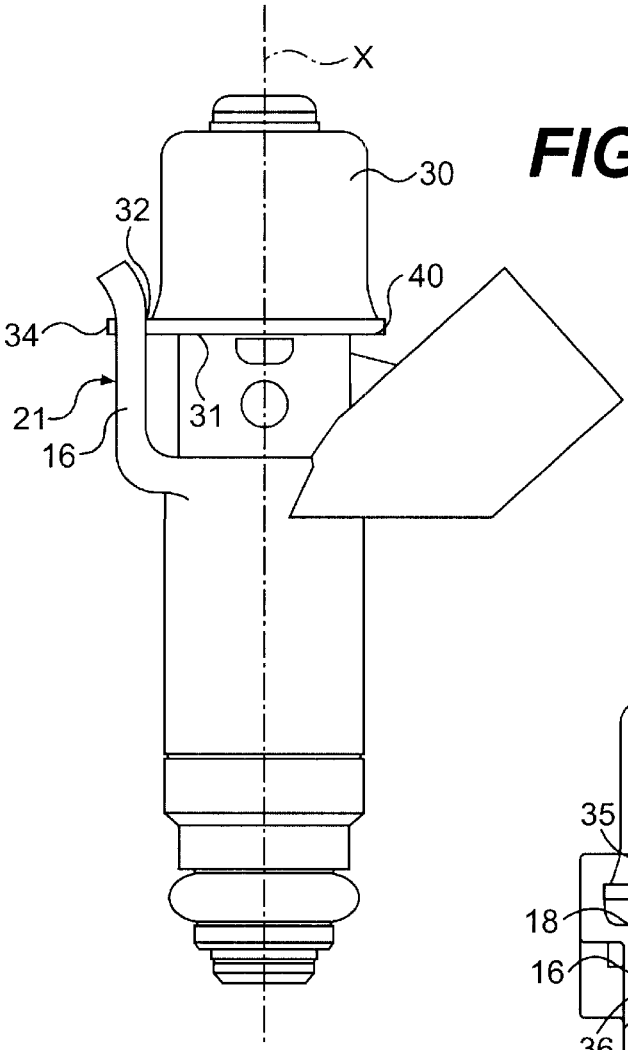
FIG. 2 is a frontal view of the assembly of the body of FIG. 1.
Figure 3:
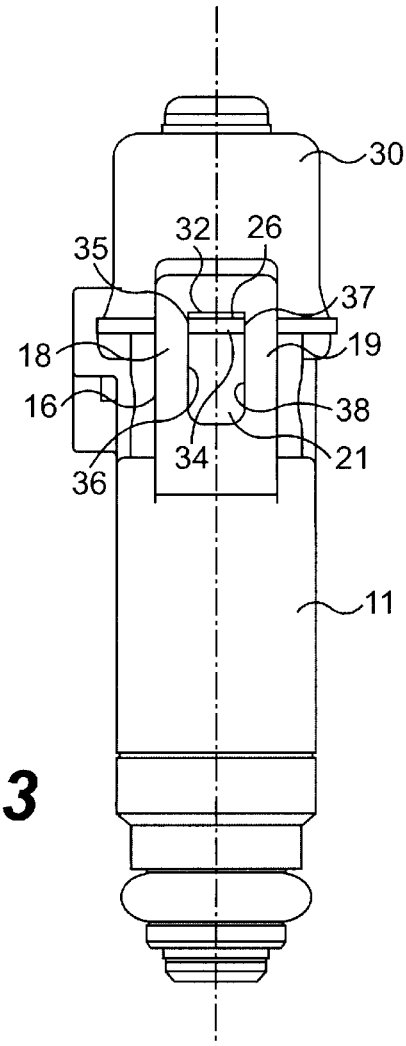
FIG. 3 is a rotated frontal view of the assembly of FIG. 2.

The fuel supply device has a cup 30 with an injector receiving opening 31 and a tab 32, as shown in FIG. 3 extending generally radially from the cup 30, as shown in FIG. 2. In the preferred embodiment, there is one tab 32, but there may be two tabs located around the cup 30 that releasably engage two fixing members (not shown). The first end 14 of the fuel injector 11 is disposed in the injector receiving opening 31. In the preferred embodiment, there is a lip 40, which is interposed between the tab 32 and the cup 30, surrounding the cup 30. The tab 32 may be connected to the lip 40 or the cup 30. The tab 32 is adapted to releasably engage the fixing member 16 and has a configuration that corresponds with the configuration of the void 21. In the preferred embodiment, when the cup 30 is installed over the first end 14 of the fuel injector 11, the tab 32 extends through at least a portion of the void 21 so that the substantially planar surface 26 releasably engages a mating surface 34 of the tab 32, as shown in FIG. 3. In the preferred embodiment, the fixing member 16 limits axial and rotational movement of the cup 30 with respect to the fuel injector 11 when the tab 32 is inserted into the void 21. The mating surface 34 is preferably facing away from second end 15 of the fuel injector 11 and transverse to the longitudinal axis x. Preferably, the tab 32 also releasably engages the first and second longitudinal legs 18 and 19, and more preferably, a first side 35 of the tab 32 engages a side 36 of the first longitudinal leg 18 and a second side 37 of the tab 32 engages a side 38 of the second longitudinal leg 19.

To releasably connect the cup 30 to the fuel injector 11, the cup is inserted over the first end 14 of the fuel injector 11. The tab 32 engages the surface 27 an biases the surface 27, as well as the legs 18, 19, and 20 from a first position away from the longitudinal axis x. The tab 32 passes the leg 20 and enters the void 21. As the tab 32 enters the void 21, the legs 18, 19, and 20 return to the first position. The mating surface 34 of the tab 32 engages the substantially planar surface 26 of the fixing member 16. To disengage the cup 30 from the fuel injector 11, the cup 30 is pressed toward the second end 15 of the fuel injector 11 along the longitudinal axis x, and the first transverse leg 20 is biased from the first position to a second position away from the longitudinal axis x. The mating surface 34 releases from the substantially planar surface 26 and exits the void 21. The cup 30 is then advanced along the longitudinal axis x away from the second end 15 of the fuel injector 11. The first transverse leg 20 is released and returns to the first position.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel supply assembly comprising:

a fuel injector, having first and second ends, including:

a fuel metering portion having a longitudinal axis extending therethrough; an outer shell surrounding the fuel metering portion; and at least one fixing member extending radially from the outer shell proximate the first end, the fixing member having first and second longitudinal legs, each having a first portion extending from the outer shell and a second portion, substantially parallel to the longitudinal axis, extending to a first transverse leg, having a substantially planar surface, the first and second longitudinal legs and the first transverse leg forming a void; and a fuel supply device having a cup, the cup including:

an injector receiving opening, the first end of the fuel injector being disposed in the injector receiving opening; and at least one tab extending generally radially from the cup, the at least one tab adapted to releasably engage the fixing member, the tab having a configuration that corresponds with the configuration of the void.

2. The fuel supply assembly of claim 1 wherein the fixing member further comprises a second transverse leg, substantially parallel to the first transverse leg, extending from the first longitudinal leg to the second longitudinal leg.

3. The fuel supply assembly of claim 1 wherein the tab extends through at least a portion of the void so that the substantially planar surface of the first transverse leg releasably engages a mating surface of the tab.

4. The fuel supply assembly of claim 1 wherein the at least one tab releasably engages the first and second longitudinal legs.

5. The fuel supply assembly of claim 1 wherein the at least one tab comprises a first side that engages a side of the first longitudinal leg and a second side that releasably engages a side of the second longitudinal leg.

6. The fuel supply assembly of claim 1 wherein when the at least one tab is inserted into the void, the fixing member limits axial and rotational movement of the cup with respect to the fuel injector.

7. The fuel supply assembly of claim 1 wherein the fuel supply device further comprises a lip, surrounding a portion of the cup, interposed between the at least one tab and the cup.

8. The fuel supply assembly of claim 1 wherein the first transverse leg comprises a surface extending toward the second end of the fuel injector and toward the longitudinal axis.

9. The fuel supply assembly of claim 1 wherein the first longitudinal leg is substantially parallel to the second longitudinal leg.

10. The fuel supply assembly of claim 1 wherein surfaces of the first and second longitudinal legs engage first and second sides of the at least one tab.

11. The fuel supply assembly of claim 1 wherein fuel injector further comprises an electrical connector extending from the outer shell, the fixing member being diametrically opposed from the electrical connector.

12. The fuel supply assembly of claim 1 wherein the first transverse leg is biased toward the first end of the fuel injector.

13. The fuel supply assembly of claim 1 wherein the fuel injector further comprises:

a fuel inlet at the first end of the fuel injector that communicates with the injector receiving opening of the fuel supply device;

a fuel outlet at the second end of the fuel injector; and an electrical connector, proximate the fuel inlet.

14. A method of releasably connecting a fuel cup to a fuel injector comprising:

providing a fuel injector, having a first and second ends, including a fuel metering portion having a longitudinal axis extending therethrough, and a fuel supply device, the fuel injector including an outer shell surrounding the fuel metering portion with at least one fixing member extending radially from the outer shell, the fixing member having first and second longitudinal legs extending to transverse leg, having a substantially planar surface and a surface extending toward the second end of the fuel injector toward the longitudinal axis, the fuel supply device including a cup with at least one tab having a mating surface;

inserting the cup over the first end of the fuel injector;

engaging the at least one tab with the surface extending toward the second end;

biasing the surface extending toward the second end, the first and second longitudinal legs, and the transverse leg from a first position away from the longitudinal axis; and engaging the mating surface of the at least one tab with the substantially planar surface of the fixing member, the first and second longitudinal legs and the transverse leg returning to the first position.

15. The method of claim 14 wherein the engaging comprises:

extending the tab through at least a portion of a void formed by the first and second longitudinal legs and the transverse leg.

16. The method of claim 14 wherein the engaging comprises:

communicating an inner surface of the first and second longitudinal legs with a first and second side of the tab.

17. A method of disengaging a fuel cup from a fuel injector comprising:

providing a fuel injector, having first and second ends and a longitudinal axis extending therethrough, and a fuel supply device, the fuel injector including an outer shell, at least one fixing member extending radially from the outer shell, the fixing member having first and second longitudinal legs extending to a transverse leg, having a substantially planar surface, the first and second longitudinal legs and the transverse leg forming a void, the fuel supply device including a cup with at least one tab having a mating surface, the cup engaging the first end of the fuel injector;

pressing the cup toward the second end of the fuel injector along the longitudinal axis; biasing the transverse leg from a first position to a second position away from the longitudinal axis, the mating surface of the tab releasing from the substantially planar surface of the transverse leg and exiting the void; and advancing the cup along the longitudinal axis away from the second end and releasing the transverse leg, the transverse leg returning to the first position.

* * * * *